US005199009A

United States Patent [19]

Svast

[11] Patent Number: 5,199,009

[45] Date of Patent: Mar. 30, 1993

[54] REMINDER CLOCK

[76] Inventor: Geno Svast, 2113 S. Gunderson Ave., Berwyn, Ill. 60402-2061

[21] Appl. No.: 753,877

[22] Filed: Sep. 3, 1991

[51] Int. Cl.[5] ..... G04C 19/02; G04B 45/00

[52] U.S. Cl. ..... 368/240; 368/41; 368/223

[58] Field of Search ..... 368/28, 29, 30, 41–44, 368/239, 241, 242, 240

[56] References Cited

U.S. PATENT DOCUMENTS

| | | | |
|---|---|---|---|
| 1,379,342 | 5/1921 | Howell | 368/29 |
| 1,757,631 | 5/1930 | Hamlin | 368/29 |
| 1,954,212 | 4/1934 | Lawler et al. | 368/29 |
| 2,495,222 | 1/1950 | Beirig | 36/30 |
| 2,867,274 | 1/1959 | Taylor . | |
| 4,362,392 | 12/1982 | Kumata . | |
| 4,548,510 | 10/1985 | Levine . | |
| 4,573,127 | 2/1986 | Korff | 368/29 |
| 4,712,923 | 12/1987 | Martin | 368/29 |
| 4,769,796 | 9/1988 | Levine | 368/29 |
| 4,868,800 | 9/1989 | Arber . | |
| 4,989,159 | 5/1978 | Yoshida | 368/29 |

*Primary Examiner*—Bernard Roskoski
*Attorney, Agent, or Firm*—Emrich & Dithmar

[57] ABSTRACT

A programmable clock includes a memory for storing times, dates and messages for subsequent read-out and display in providing a reminder of a birthday, anniversary, doctor's appointment, meeting, etc. The clock is adapted for prominent display by mounting to a wall or other support structure and provides a user with a visual display of stored reminder messages, as well as an indication of the content of the reminder message, over a given future time period, i.e., all stored reminder messages for today, tomorrow, or some other selected day in the future. The reminder clock also includes a speaker and an audio recorder for providing a reminder message in the user's own voice, as well as a printer for providing more extensive reminder messages as well as a list of all stored reminder messages. The reminder clock makes use of any one of several analog and combined analog and digital time displays which are easily read and understood, including a display presenting an analog representation of hours and a digital display of minutes. Various audio and/or video alarms are provided to indicate the read-out and display of a reminder message. An electronic pendulum is provided to indicate proper operation of the reminder clock as is a calendar indicating the days and times when stored reminder messages are to be recalled from memory and displayed.

11 Claims, 7 Drawing Sheets

REMINDER CLOCK

FIELD OF THE INVENTION

This invention relates generally to clocks and is particularly directed to a clock having a programmable memory as well as various visual and audio indicating means for providing a visual or aural indication of a message stored in the memory for subsequent read-out and display at a designated time.

BACKGROUND OF THE INVENTION

Electronic clocks and watches have become increasingly sophisticated with the recent significant advances in solid state technology. In addition to indicating the time and providing an alarm function, these clocks and watches now function as a time scheduler and event indicator. For example, clocks and watches are now available which provide advanced as well as a current warning of a designated date and time having an associated event such as an appointment or meeting. Clocks of this type are generally of the digital type having an enclosed housing containing the clock, memory and user selection electronics and adapted for positioning on a support surface such as a desk or table. As such, these types of clocks are not as prominently displayed as a wall-mounted clock and provide only limited capability for advanced notification of future events.

Analog time presentations are generally more aesthetically pleasing and are adapted for greater variety in presentation than digital displays. However, heretofore such analog time displays have been severely limited in the amount of information which could be presented and are thus of only limited utility in current electronic diaries and time schedulers.

The present invention overcomes the aforementioned limitations of the prior art by providing a reminder clock adapted for mounting to a wall or other support structure in a prominent manner which provides current time as well as advanced notice of events stored in a memory for subsequent recall and the time of recall and which employs an attractive analog time display presenting various information.

OBJECTS AND SUMMARY OF THE INVENTION

Accordingly, it is an object of the present invention to provide a clock mounted to a wall or other support structure for not only indicating the time, but also for alerting a user to stored messages at designated times.

Another object of the present invention is to provide a programmable clock having a memory for storing times, dates and messages for subsequent recall and display in providing a reminder of birthdays, anniversaries, appointments, meetings, etc.

Yet another object of the present invention is to provide a clock for not only reminding one of the time of a previously stored entry, but also the content of the stored entry, i.e., whether a birthday reminder, an appointment reminder, etc.

A further object of the present invention is to provide a clock with an improved combination analog and digital display which is easily read and understood.

A still further object of the present invention is to provide a clock for simultaneously displaying current time as well as future stored times at which various previously stored reminder messages are to be displayed together with associated visual and/or audio reminder alarms.

Still another object of the present invention is to provide a color coded, combined analog and digital display for use in an integrated clock and alarm reminder device which is easily read an interpreted and is attractive.

It is another object of the present invention to provide a reminder device for providing a visual, audio, or print-out indication of a previously entered message in a clock, where the audio indication may be a prerecorded message in the voice of the user of the reminder device.

These objects of the present invention are achieved and the disadvantages of the prior art are eliminated by a reminder clock mounted to a wall or similar support structure for entering and storing reminder messages of events and appointments for subsequent recall, the reminder clock comprising: a clock adapted for attachment to and suspension from a wall or similar support structure, the clock including a plurality of first analog and first digital display elements for displaying current time in hours and minutes, respectively, and a plurality of second analog and second digital display elements for displaying the time in hours and minutes, respectively, of the time of recall of each of the reminder messages, wherein each analog display element represents an hour position on the clock and each digital display element comprises a digital read-out disposed adjacent each of the analog display element; a keyboard disposed on the clock for entering the reminder messages and the time for recall of each of the reminder messages; controller coupled to the clock and to the keyboard for processing the reminder messages and recall times associated therewith; a memory coupled to the controller for storing the reminder messages for subsequent recall at the recall times by the controller; and an alphanumeric display disposed on the clock and coupled to the controller for displaying the reminder messages read from the memory by the controller at a respective one of the recall times.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures in which:

DETAILED DESCRIPTION OF THE PREFERRED EMBODIMENTS

Figure 1:
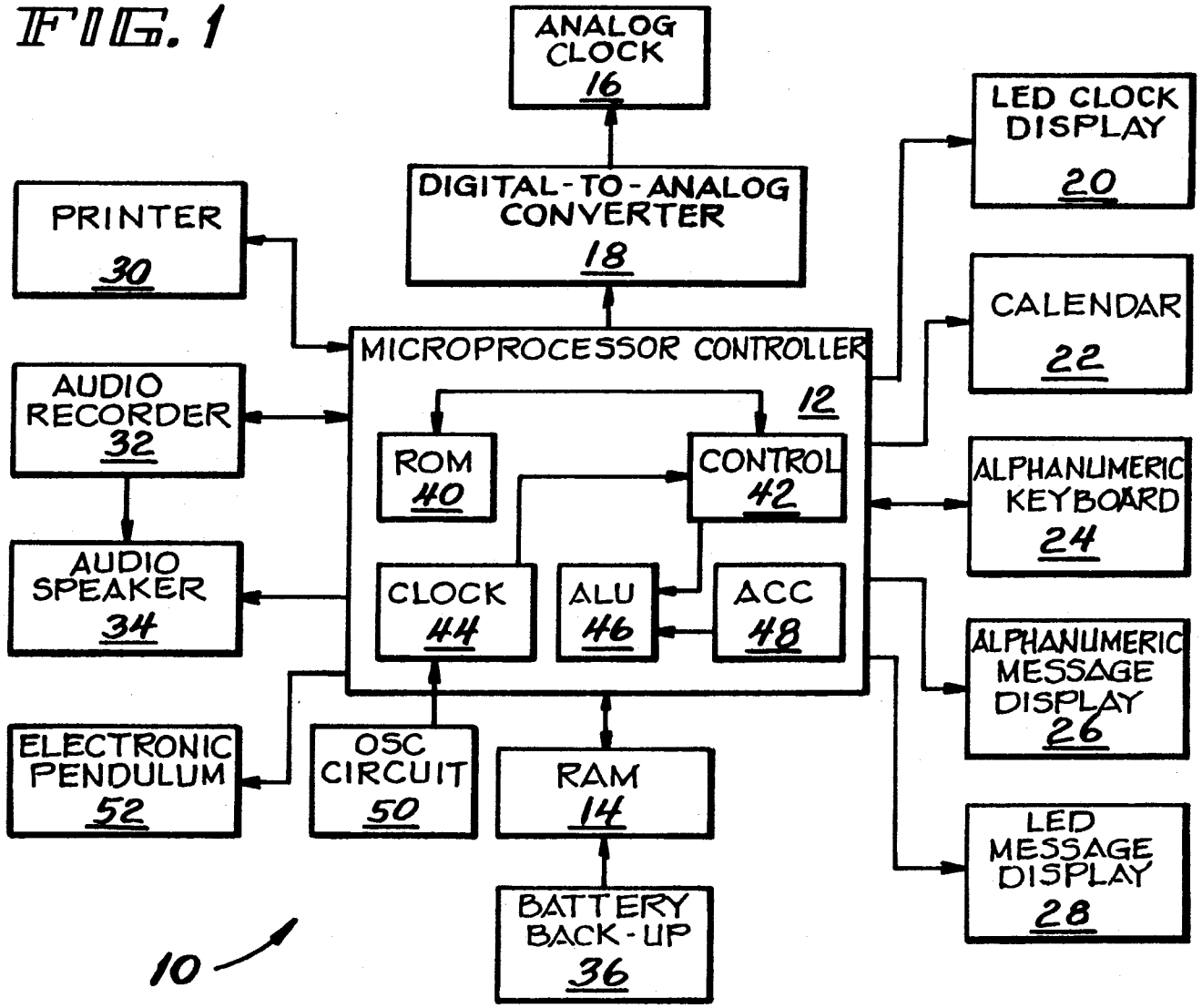
FIG. 1 is a simplified block diagram of a reminder clock in accordance with the principles of the present invention.

Referring to FIG. 1, there is shown a block diagram of a reminder clock 10 in accordance with the present invention. The reminder clock 10 includes a microprocessor controller 12 coupled to various peripherals for receiving control inputs from these peripherals and providing control outputs to the peripherals in carrying out the various clock display and message reminder functions described in detail below.

Microprocessor controller 12 may be conventional in design and includes a read only memory (ROM) 40, a controller 42, a clock 44, an arithmetic and logic unit (ALU) 46, and an accumulator 48. Microprocessor controller 12 stores instructions and data, periodically updates the stored data, compares both stored and real-time data, and makes decisions based upon these comparisons by means of logic instructions in providing for control of the reminder clock 10. ROM 40 is nonvolatile, factory produced memory matrix which includes a plurality of memory locations or "bytes", preferably of 8 bits each.

An oscillator circuit 50 external to the integrated circuit (IC) microprocessor controller 12 provides timing signals to clock 44 for controlling the timing of the operations carried out by the microprocessor. Program instructions and data are stored in ROM 40. When power is applied to microprocessor controller 12, the microprocessor program stored in ROM 30 causes binary signals representing a first instruction stored in the ROM to be provided to the controller 42 for proper initialization of the microprocessor controller. ALU 46 receives binary control signals from controller 42 and performs the required arithmetic or logic operation.

User entries are made to the microprocessor controller 12 by means of a user operated alphanumeric keyboard 24. Keyboard 24 is continually scanned by the microprocessor controller 12 for the detection of entries thereon. Entries provided to the microprocessor controller 12 via keyboard 24 may include such information as the date and time of a message for subsequent presentation on an alphanumeric message display 26 coupled to the microprocessor controller 12. The content of the message to be subsequently displayed is also entered via keyboard 24. Time and date information as well as information relating to a specific time and date entered via keyboard 24 and provided to microprocessor controller 12 are stored in a random access memory (RAM) 14. Microprocessor controller 12 thus writes data into RAM 14 for storage therein and reads, or recalls, stored data from the RAM in controlling the operation of the reminder clock 10. RAM 14 may be provided with a battery-backup 36 to prevent loss of data stored in the RAM in the event of a power failure or removal of power from the reminder clock 10. Reminder clock 10 may be powered either by a conventional AC line or may be battery powered and include a battery-backup 36 to prevent loss of data stored in RAM 14.

Reminder clock 10 further includes a calendar 22 indicating the year, month, day of the week, and date in a conventional matrix format. Each block representing a given day and date of a month includes a respective light element such as a light emitting diode (LED) or a liquid crystal diode (LCD) providing the date as well as the time on that given date a message stored in RAM 14 is to be automatically read from the RAM by the microprocessor controller 12 and provided to the clock 16 and alphanumeric message display 26 for presentation thereon.

The operating program for controlling the microprocessor controller 12 is stored in its ROM 40. A program counter (not shown) monitors program instruction execution and ensures proper sequencing of instructions output from ROM 40. The program stored in ROM 40 writes to or reads from the data memory RAM 14 for transferring data to/from the RAM for carrying out the program instructions selected in ROM, or program memory, 40. A timer/event counter (also not shown) receives program operating information from the microprocessor controller's internal bus and provides timing information to conditional branch logic circuitry to permit the operating program to make decisions and control its operation in response to the instructions read from ROM 40. I/0 ports couple the microprocessor controller's internal bus to various lines of the microprocessor controller 12 and serve as a buffer for the signals provided from and to the microprocessor controller via its lines. The configuration of microprocessor controller 12 as used in the present invention is conventional in design, does not form a part of the present invention, and will not therefore be described further herein.

The microprocessor controller 12 outputs digital signals, a digital-to-analog converter 18 couples the microprocessor controller to the clock 16 for driving the analog time display portion of the clock. Digital information may also be provided directly to clock 16 for driving the digital minutes displays described below.

Various embodiments of the present invention include a combined analog and digital time display. For example, in one embodiment described below analog time information is presented by sequentially illuminating each of a plurality of LEDs positioned about the face of clock 16 and representing each hour on the clock face. The time in minutes after each hour is displayed digitally on a respective one of a plurality of LED clock displays. Reminder clock 10 further includes an LED message selector and display 28 for providing stored message information for recall over the next several days. Each selector LED 28 represents a given day including the present day as well as the next six days and indicates on which of those days a message will be read from memory and displayed on the reminder clock 10. Each selector LED 28 may be manually engaged by a user for displaying on the alphanumeric display 26 all reminder messages which have been stored for the selected day.

Reminder clock 10 further includes a printer 30 also coupled to and driven by microprocessor controller 12 for providing a hard copy of stored messages for a given day or other selected time period. An audio recorder 32 in combination with a speaker 34 both coupled to the microprocessor controller 12 allows for recording of a message in one's own voice for subsequent playback at a selected time on a given day. By directly coupling audio speaker 34 to microprocessor controller 12, other forms of audio alerts can be provided by the reminder clock 10 such as a bell, beep, music, or other alarm indication of a reminder message. An electronic pendulum 54 may be coupled to and driven by the microprocessor controller 12 for providing a visual indication of operation of the reminder clock 10. The electronic pendulum 52 is described in greater detail below. Finally, various interface devices couple the microprocessor controller 12 to the various peripherals described above. For example, a printer interface circuit would typically couple the microprocessor controller 12 to printer 30, while a keyboard interface circuit would typically be provided for coupling the microprocessor controller to the alphanumeric keyboard 24. Such interface circuits are well known to those skilled in the relevant arts and have not been included in the figures and ar not discussed further herein for simplicity.

Figure 2:
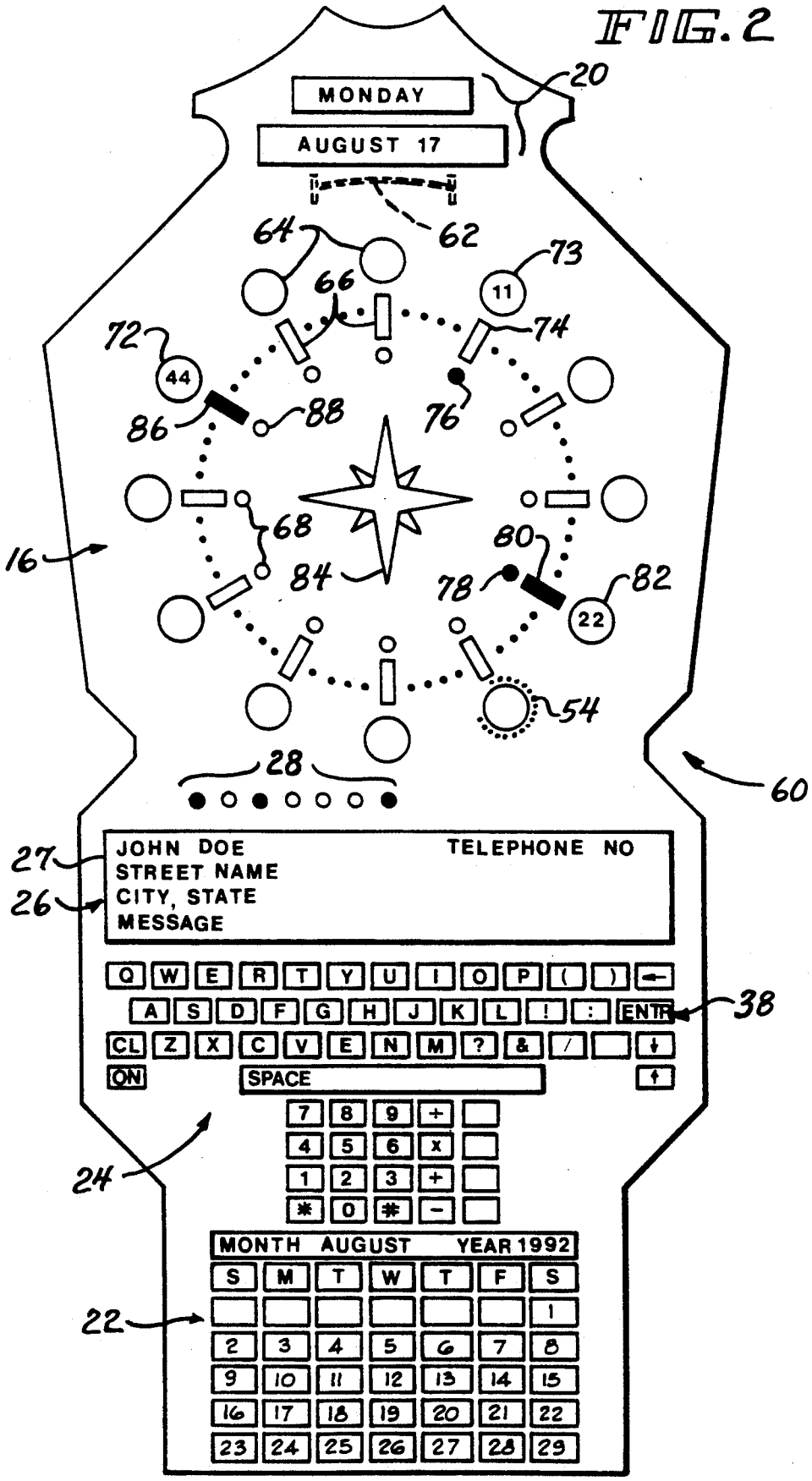
FIG. 2 is an elevation view of a time display, alphanumeric message display, a calendar, and keyboard data entry arrangement for us in one embodiment of the present invention.

With reference to FIG. 1 as well as to FIG. 2 which is an elevation view of a control and display arrangement 60 for the reminder clock 10, additional details of the reminder clock will now be described. Control and display arrangement 60 includes an analog and digital clock display 16 as well as an alphanumeric day and date display 20. Reminder clock 10 is adapted for attachment to and suspension from a support structure such as a wall by means of a support wire 62 located on the back of reminder clock and shown in the figure in dotted-line form. The alphanumeric day and date display 20 provides current da and date information.

Disposed about the clock 16 in a generally circular array are twelve analog hour displays 66. Each analog hour display 66 represents an hour indicator on the clock 16 and is generally in the form of an elongated, linear bar which may be comprised of an LED or LCD. Disposed adjacent an inner end of each of the analog hour displays 66 is respective AM/PM indicator 68. With the illumination of an analog hour display 66 representing the current hour, illumination of an associated AM/PM indicator 68 represents that the current time is PM. Non-illumination of an AM/PM indicator 68 associated with an illuminated analog hour display 66 indicates that the indicated hour is AM. AM/PM indicator 68 may also be provided with a first color (such as green) to indicate AM and a second color (such as blue) to indicate PM. As time passes, each analog hour display 66 illuminates in sequence providing an analog indication of the current hour. Disposed adjacent to and outside of the generally circular array of analog hour displays 66 are a plurality of digital minute displays 64. Each digital minute display 64 includes two-digit display for displaying the minutes after the displayed hour. For example, referring to the one o'clock position on the clock 16, illumination of analog log hour display 74 with the number "11" displayed in its associated digital minutes display 73 provides an indication of the current time. With AM/PM indicator 76 illuminated, the time indicated by analog hour display 74 and digital minutes display 73 is 1:11 PM.

To provide an added capability for clock 16, the analog hour display representing current time may be provided with one color, while other analog hour displays may be provided with another color for providing a visual indication of reminder times stored in RAM 14 for subsequent recall by the microprocessor controller 12. For example, analog hour display 74 representing the current hour may be displayed in the color yellow, while second and third analog hour displays 80 and 86 may be displayed in red for representing the time of stored reminder messages in RAM 14 for later display on the clock 16. Also, the ENTER key 38 can be pressed to view appointments of the day appearing on the clock 16 in their sequence with display of information in the alphanumeric display 26. In addition, AM/PM indicator 78 associated with analog hour display 80 is illuminated and digital minutes display 82 displays the number "23" to indicate that a reminder message will be presented on the control and display arrangement 60 at 4:23 PM. Similarly, the non-illumination of AM/PM indicator 88 and the presentation of the number "45" in digital minutes display 72 associated with illuminated analog hour display 86 indicates that another reminder message and associated alarm will be presented on the control and display arrangement 60 at 10:45 AM. Disposed in the center of the clock 16 is a visual alarm display 84 which may be in the form of an LCD, an LED, or other conventional light source for providing a visual indication of the presentation of a reminder message in the alphanumeric message display 26 or that a reminder message will be displayed within a selected time period, i.e., within the next five (5) minutes. A visual alarm via display 84 may also include flashing of an illuminating frame 27 which may be comprised of LEDs disposed about the alphanumeric message display 26. A visual alarm of a reminder message may also be provided via alternating flashing of the analog hour display 74 and its associated digital minutes display.

Disposed about each digital minutes display are a plurality of spaced LED second indicators 54, which are only shown disposed about the 5:00 o'clock digital minutes display 56 for simplicity. In a preferred embodiment, there are sixty (60) such LED second indicators 54 disposed about each digital minutes display. The LED second indicators 54 illuminate sequentially with the passage of each second for each minute presented on the digital minutes display. Thus, with a change in minutes all LED second indicators 54 for that particular digital minutes display are turned off, followed by sequential illumination of each LED second indicator in succession for the next minute. The LED second indicators 54 may be provided with virtually any color. The LED second indicators 54 also provide a viewer with a visual indication that the clock 16 is operating.

Also disposed on the control and display arrangement 60 are a plurality of LED message displays 28 arranged in a generally linear array and each having a respective color associated therewith. Each LED message display 28 represents a particular day, with the left-most message display representing the current day, the next rightward message display representing tomorrow, etc., with the message display on the right representing six days from the current day. Illumination of one of the LED message displays 28 indicates reminder message information stored in memory for recall and display on the control and display arrangement 60 for that particular day. For example, illumination of the LED message display on left indicates that the reminder message information displayed on clock 16 is for the current day. Each LED message display 28 may be color-coded for a particular day of the week. Thus, blue may designate Monday, yellow may designate Tuesday, etc.

Microprocessor controller 12 is programmed so as to be responsive to user initiated entries on keyboard 24 for selecting and displaying reminder message information for a given day including the current day and up to six days in the future. Disposed above keyboard 24 is a multi-line alphanumeric message display 26. Message display 26 provides a visual indication of reminder message information when entered via keyboard 24 and also provides for the display of this information upon subsequent recall of the reminder message from RAM 14 by the microprocessor controller 12. Virtually any type of reminder message may be entered via keyboard 24 and displayed on the alphanumeric message display 26, with various alphanumeric characters and other symbols available on the keyboard. Once entered via keyboard 24 and displayed on the alphanumeric message display 26, the reminder message as well as its associated day, date and time of recall may be stored in RAM 14 by a conventional step such as selecting the ENTER key 38 on keyboard 24.

Disposed below keyboard 24 on the control and display arrangement 60 is a calendar 22. Calendar 22 includes locations for displaying the current month and year as recalled from data stored in the microprocessor controller's ROM 40. Calendar 22 further includes a plurality of spaced blocks, each containing a respective date associated with a given day of the week. Each block has associated therewith a pair of LEDs to allow the date of a given day to change with each month. Also associated with each date block is a LED time display which is shown for the dates of August 2 and August 17. The time display for a given date is illuminated to represent the time on that date for which a reminder message has been stored in RAM 14 for subsequent recall. Thus, as shown in FIG. 2, a reminder message has been stored in RAM 14 for recall at 3:00 PM on Aug. 2, 1991, as well as at 7:00 AM on Aug. 17, 1991. If more than one message is stored for a given date, the times these messages are to be recalled on that date will be displayed on the appropriate date indicator on calendar 22 in a sequential manner. Calendar 22 thus provides a user with a display of the date and day of the week for each day of the month as well as a display of the day, date and time associated with any reminder messages stored in RAM 14 for recall and display during that month. If more than one appointment is recorded, other subsequent appointments will be changing hours in sequence on that day. Calendar 22 is preferably of the perpetual type which repeats and updates itself each year to eliminate the need to enter selected dates such as birthdays each year. The contents of calendar 22 are stored in and read from RAM 14. The day and date indicators are illuminated for each day of the month.

Figure 3:
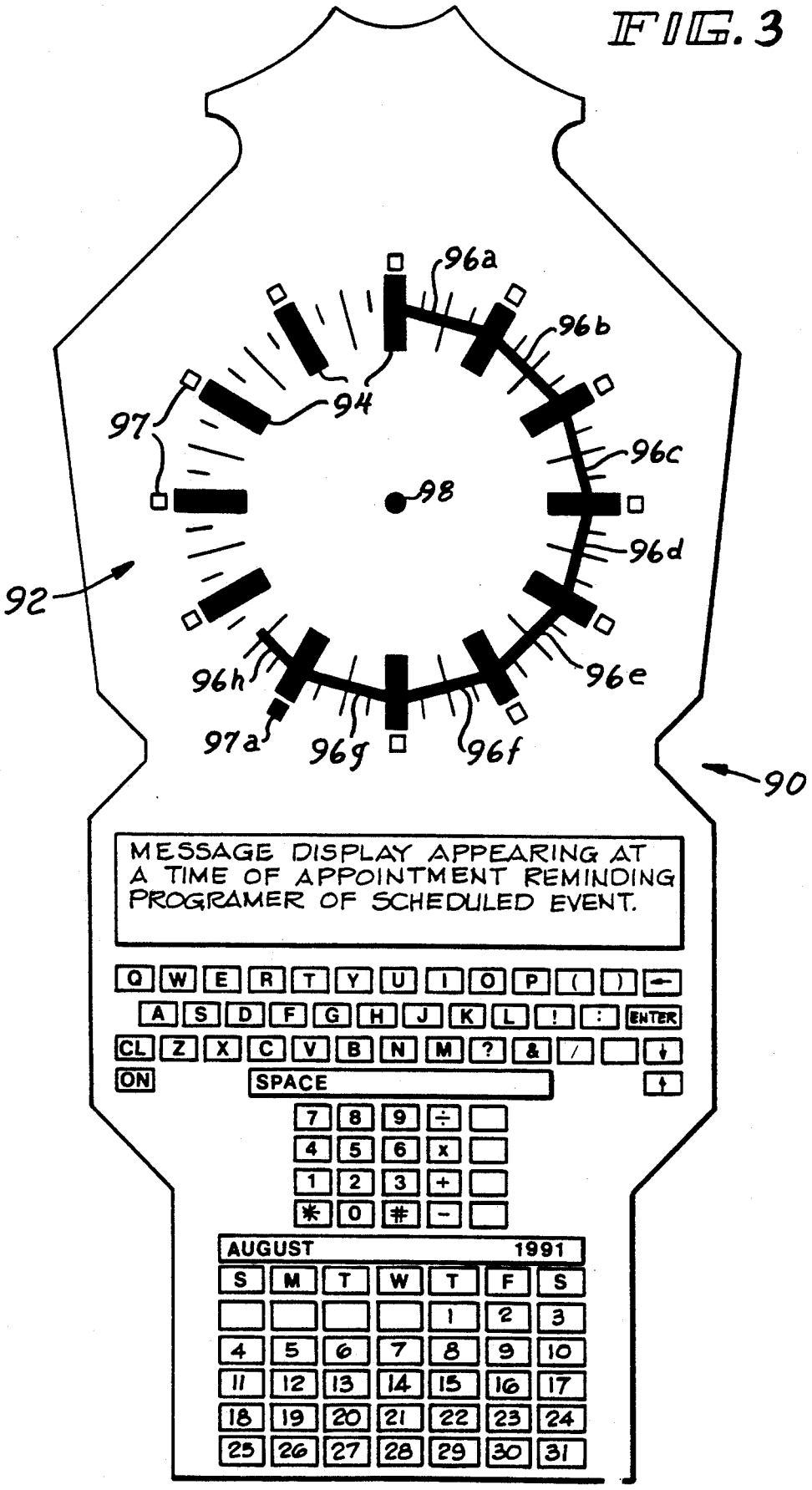
FIG. 3 illustrates an analog time display for use in another embodiment of the present invention.

Referring to FIG. 3, there is shown another control and display arrangement 90 which includes another embodiment of a clock 92 for use in the reminder clock of the present invention. Clock 92 provides an entirely analog presentation of the current time and includes a plurality of spaced hour LEDs 94. The hour LEDs 94 are arranged in a generally circular array as in a conventional clock and all LEDs are continuously illuminated. Disposed between adjacent hour LEDs 94 are a plurality of smaller, segmented LEDs **96*a*-96*h* which may be provided with a color different than that of the hour LEDs. For example, the hour LEDs 94 may be blue in color, while the segmented LEDs 96*a*-96*h* may be green. The passage of time causes successive adjacent segments of the minute LEDs to become illuminated. For example, at 1:00 the entire length of segmented LED 96*a* will be illuminated. The time shown on clock 92 is 7:40 because of the partial illumination of segmented 96*h*. illumination of LED 112 in the center of clock 92 indicates that the hour indicated is PM. The segmented LEDs 96*a*-96*h* may be selected to show the time in as small as one (1) minute intervals or as long as fifteen (15) minute intervals. A plurality of reminder indicators 97 are disposed about clock 92. When a reminder occurs, or a predetermined time before the occurrence of a reminder, an appropriate reminder indicator flashes to provide a visual indication of a reminder as shown for the case of reminder indicator 97*a***. While the analog minutes indicator is disclosed as segmented LEDs, it is not limited to this type of component, but may also be a mechanical-type indicator such as rotating disk.

Figure 4:
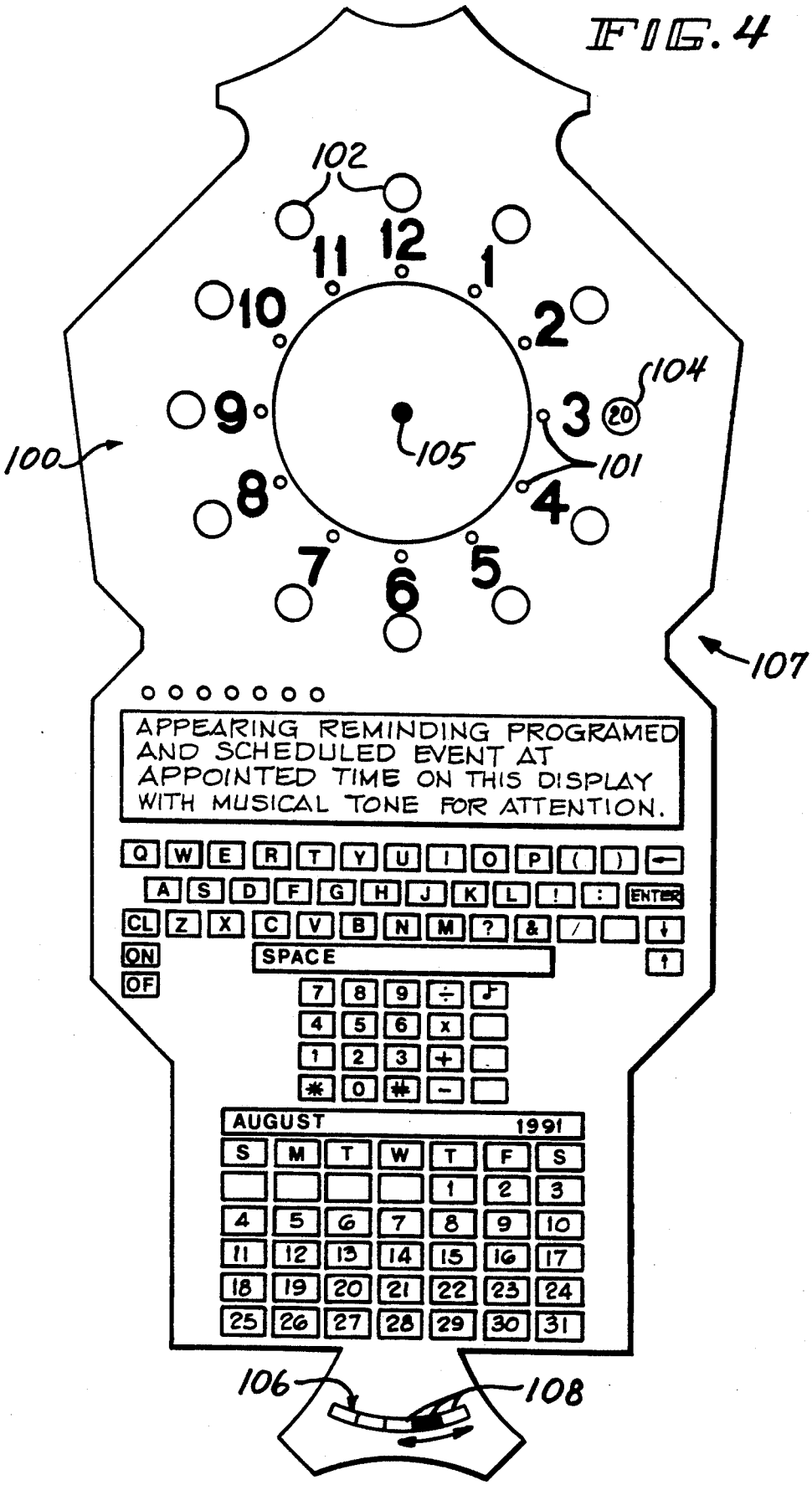
FIG. 4 shows another embodiment of a combined analog and digital time display for use in the present invention.

Referring to FIG. 4, there is shown another clock display 100 for use in the reminder clock 107 of the present invention. Clock display 100 includes a plurality of numerical hour indicators arranged in a generally circular array as is conventional. Each of the twelve hour digits is adapted for illumination for a given hour of time. Thus, the digit "1" will be illuminated from 1:00 AM to 2:00 AM and for the period of 1:00 PM to 2:00 PM. Disposed adjacent each of the hour digits is a respective digital minutes indicator 102. Each of the digital minutes indicators 102 includes a pair of digital readouts for providing an indication of the time in minutes after a given hour. For example, with hour indicator "3" illuminated and the number "20" presented in digital minutes indicator 104 as shown in FIG. 4, the current time is 3:20. Illumination of an AM/PM indicator 105 in the center of clock display 100 indicates that the current time is 3:20 PM.

Disposed on a lower portion of reminder clock 107 is an electronic pendulum 106. Electronic pendulum 106 includes a plurality of LEDs 108 disposed along an arcuate display member. Each of the LEDs 108 is turned on in sequence to provide a pendulum effect wherein the timing element is displaced in a reciprocating manner in the direction of the arrows in the figure. Sequential illumination of the LEDs 108 gives the appearance of a mechanical pendulum-type device and provides a viewer with a visual indication that clock 107 is operating. A plurality of reminder indicators 101 are disposed about clock 100, with the reminder indicator closest in time to the reminder time illuminating when a reminder time is reached.

Figure 5:
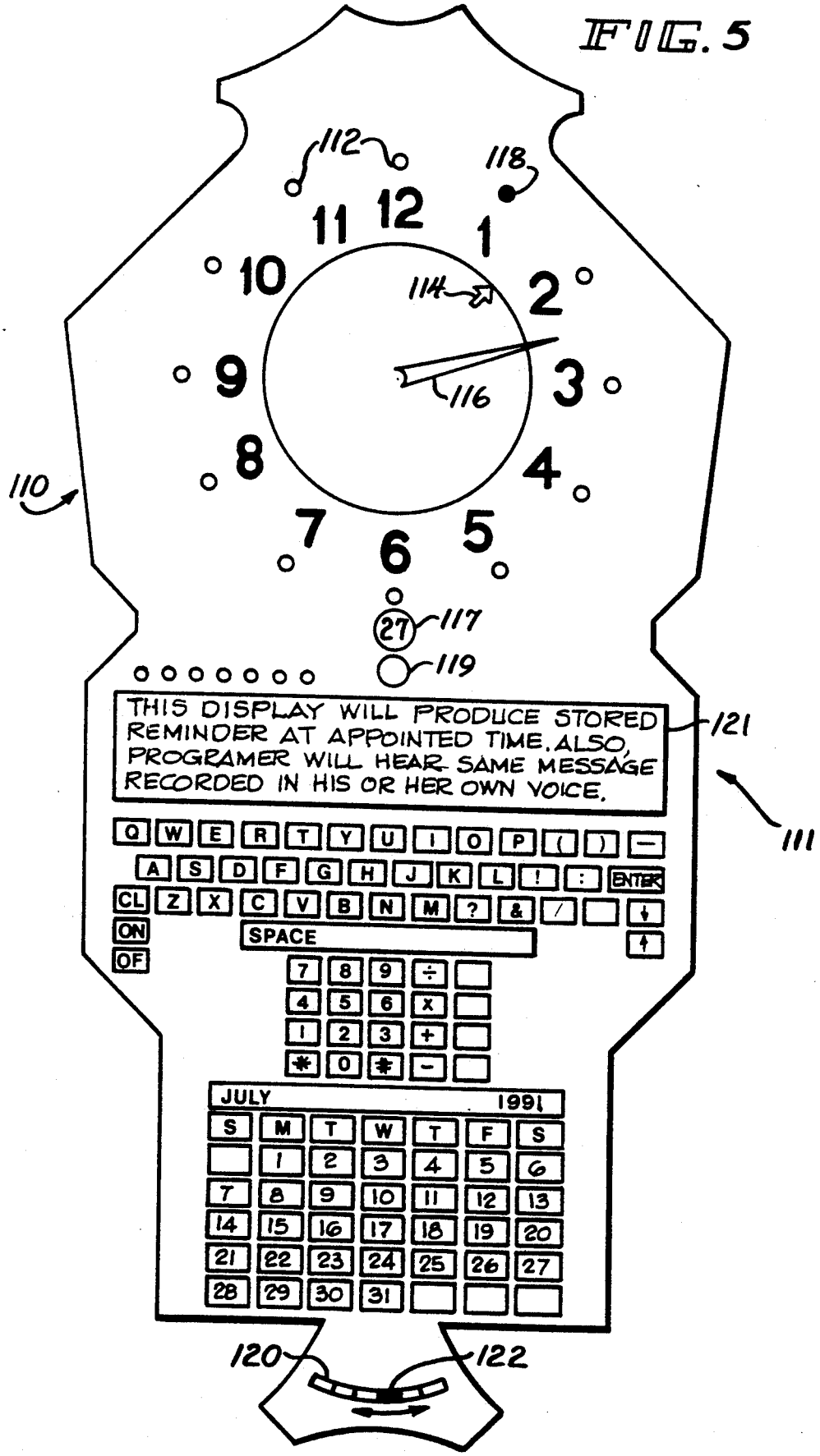
FIG. 5 illustrates another analog display for use in the reminder clock of the present invention.

Referring to FIG. 5, there is shown another clock display 110 for use in a reminder clock 111 in accordance with the present invention. Clock display 110 includes rotating hours hand 114 and minutes hand 116 disposed within a circular array of hour-indicating digits. Disposed adjacent and outside each hour digit is a light indicator 112. Each hour digit therefore has an associated light indicator 112 disposed adjacent thereto. Illumination of a light indicator 112 indicates that an appointment time has been reached. For example, illumination of light indicator 118 with the hour and second hands 114, 116 displaying a time of 1:12 as shown in FIG. 5 indicates that an appointment time has been reached. The numbers of the digital display may be illuminated at an appointment time with flashing. Also, the hour and minute hands 114 and 116 may be illuminated when an appointment time is reached. This embodiment of a reminder clock 111 in accordance with the present invention also includes an electronic pendulum 112 including a plurality of adjacent sequentially illuminated LEDs 122 which provide a moving pendulum appearance when the reminder clock 111 is in operation. Reminder clock 111 further includes a digital countdown indicator 117 providing a visual indication of the number of days remaining before the occurrence of a selected reminder time. Also provided is a manual selector 119 for providing a visual indication on an alphanumeric display 121 of the nature of the reminder message.

Figure 6:
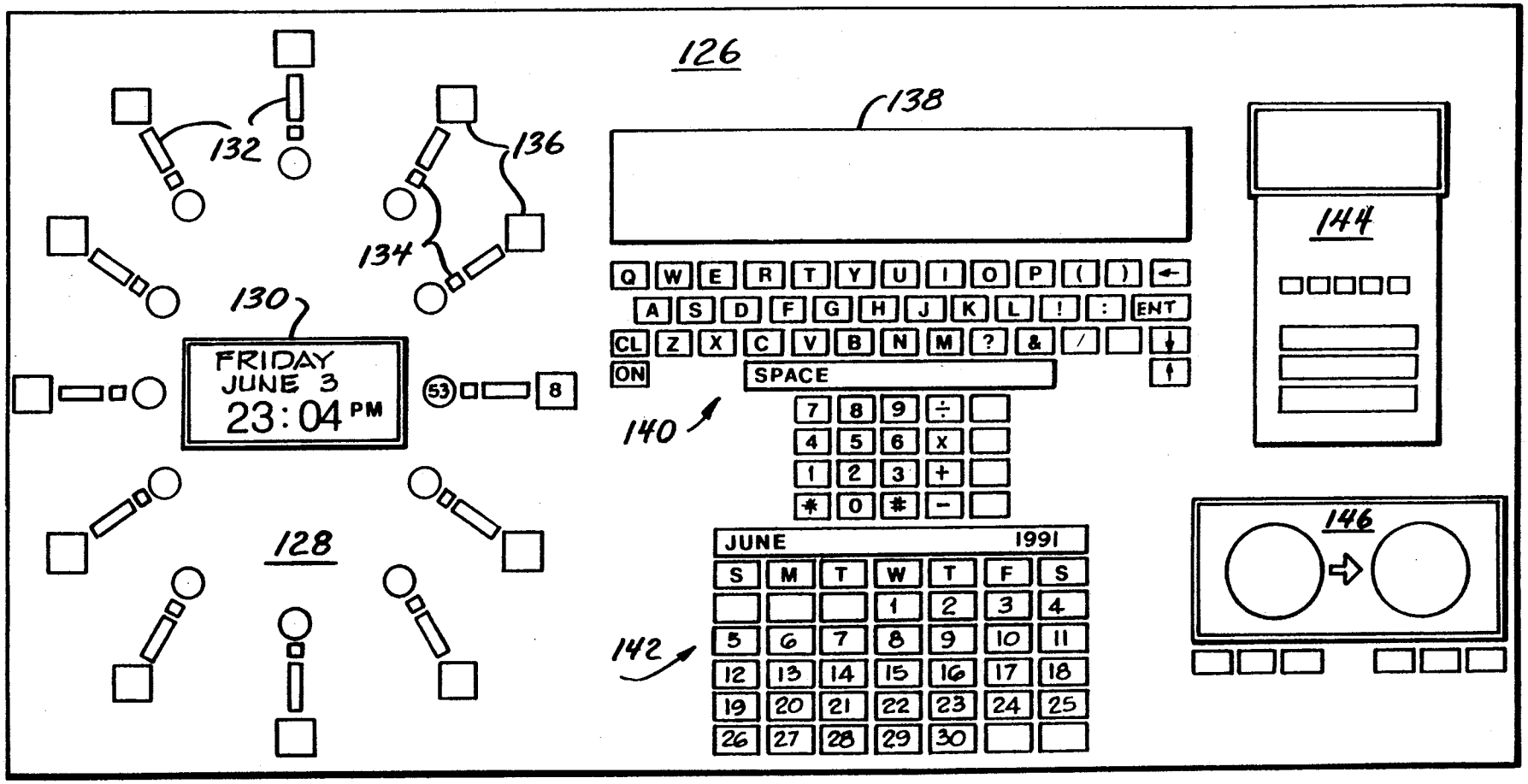
FIG. 6 illustrates yet another combined analog and digital time display, alphanumeric message display, calendar, and keyboard data entry arrangement for use in the reminder clock of the present invention.

Referring to FIG. 6, there is shown another format for a reminder clock 126 in accordance with the principles of the present invention. Reminder clock 126 includes a clock 128 having a plurality of spaced hour indicators 132, a plurality of spaced AM/PM indicators 134, and a plurality of spaced digital minutes indicators 136. Illumination of an hour indicator 132 indicates the current hour, while the digits displayed in a digital minutes indicator 136 represents the minutes after the indicated hour. Illumination of an AM/PM indicator 134 associated with a pair of hour and minute indicators 132, 136 indicates that the current time is PM. Each associated combination of hour, AM/PM, and minutes indicators 132, 134 and 136 is sequentially illuminated about the generally circular array of indicators in a clockwise direction. Also included in the clock display 128 is a day/date display 130.

Clock display 128 further includes a plurality of digital seconds displays 124 each disposed adjacent a respective one of the hour indicators 132 and digital minute indicators 136. With a given hour indicator 132 illuminated and its associated digital minute indicator 136 displaying the current minute, the seconds will be displayed digitally in the associated seconds display 124. The seconds display cydes through 1-60 for each minute.

Reminder clock 126 further includes an alphanumeric message display 138 for providing a presentation of the message stored in and read from the reminder clock's RAM. Keyboard 140 is provided for permitting an operator to enter reminder message and day date and time information relating to the reminder message. A calendar 142 displays the dates of each day of the month as well as an indication of those days on which a reminder message will be presented on the reminder clock 126 and the time the reminder message will be displayed. Also included in the reminder clock 126 is a printer 144 for providing a hard copy listing of reminder message information stored in the reminder clock's RAM for subsequent recall and display. Finally, reminder clock 126 includes a tape recorder 146 for storing an audio message associated with a stored reminder message for later play back at the time of recall and display of the reminder message. The audio message allows the user of the reminder clock 126 to record and later hear an audio message associated with a stored reminder message in his or her own voice.

Figure 7:
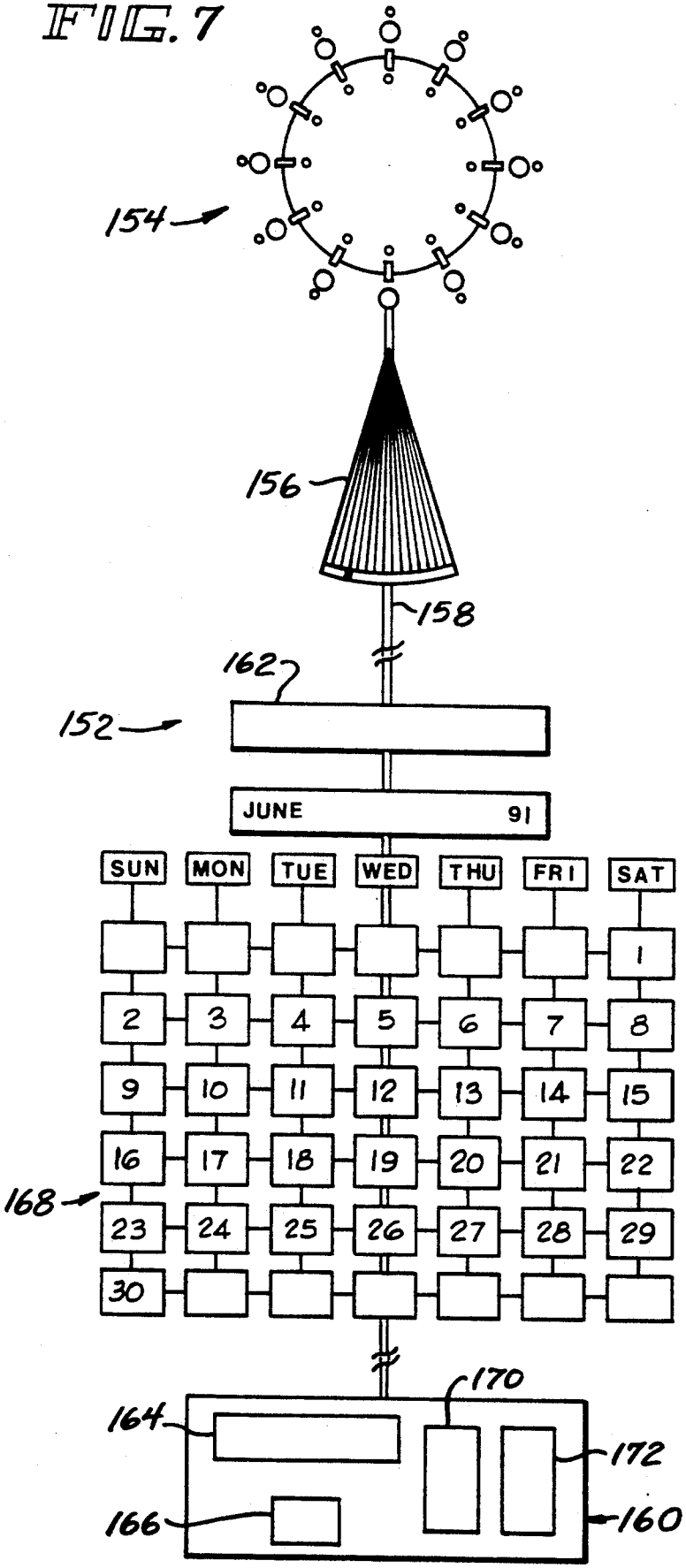
FIG. 7 is a simplified schematic diagram of another embodiment of a reminder clock in accordance with the present invention.
Figure 8:
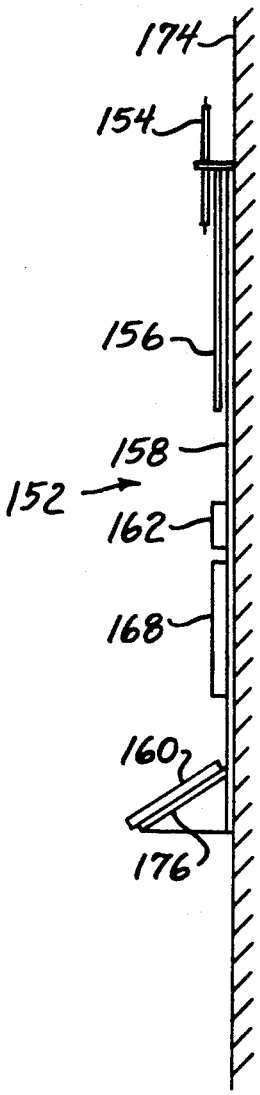
FIG. 8 is a side view of the reminder clock shown in FIG. 7.

Referring to FIG. 7, there is shown a simplified schematic diagram of another embodiment of a reminder clock 152 in accordance with the principles of the present invention. A side elevation view of the reminder clock 152 is shown in FIG. 8. Reminder clock 152 includes a clock display 154 coupled to a control and display arrangement 160 by means of an electrical lead, or connection, 158. Disposed intermediate clock 154 and the control and display arrangement 160 and also coupled to the control and display arrangement by means of electrical lead 158 is a pendulum 156. Clock 154 and pendulum 156 are adapted for mounting to a wall 174, or other similar support structure. Pendulum 156 may be either mechanical, electro-mechanical, or electronic. One embodiment of pendulum 156 may include a plurality of spaced members extending downward from clock 154 with a space provided between each downward extending member. A moving member disposed aft of the fixed downward extending members is displaced in a pendulum-like manner as it traverses the spaces intermediate the downward extending members to provide a discontinuous moving pendulum effect. A similar effect may be achieved by the sequential illumination of light emitting elements in a timed manner. Both approaches are well known to those skilled in the relevant arts and are thus not further described herein.

As in the previous embodiments, the control and display arrangement 160 includes an alphanumeric message display 162, a letter keyboard 164, and a numerical keyboard 166 which allows a user to enter message and time information in the control and display arrangement 160. Numerical keyboard 166 may also function as a calculator using the alphanumeric message display 162. The control and display arrangement 160 further includes a calendar 168 with illuminating day and date indicators, a tape recorder 170, and a printer 172.

Electrical lead 158 extends downward from clock 154 and pendulum 156 which are securely mounted to wall 174. Disposed below clock 154 and pendulum 156 and also mounted to wall 174 is a support pedestal 176. Support pedestal 176 is adapted for receiving and supporting control and display arrangement 160. The arrangement of reminder clock 152 facilitates viewing of clock 154 and pendulum 156 and user op®ration of the control and display arrangement 160. By positioning the control and display arrangement 160 on a readily accessible support pedestal 176 below the clock 154 and pendulum 156, user control over and operation of the reminder clock 152 is facilitated while retaining high visibility for the clock 154 and pendulum 156. The alphanumeric display 162 and calendar 168 are also affixed to wall 174 above the support pedestal 176 for improved visibility. The support pedestal 176 may include a collapsible bracket 178 to allow the support pedestal and control and display arrangement 160 to be folded in close proximity to wall 174 and thus out of the way when not in use.

There has thus been shown a programmable reminder clock including a memory for storing times, dates and messages for subsequent read-out and display in providing a reminder of a birthday, anniversary, doctor's appointment, meeting, etc. The reminder clock is particularly adapted for prominent display by mounting to a wall or other support structure and includes a unique combined analog and digital time display which is easily read and understood and provides not only an indication of current time, but also the times any reminder messages will be read from memory and prominently displayed for alerting a user of the reminder clock.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A reminder clock mounted to a wall or similar support structure for entering and storing reminder messages of events and appointments for subsequent recall, said reminder clock comprising:

clock means adapted for attachment to and suspension from a wall or similar support structure, said clock means including a plurality of first analog and first digital display means for displaying current time in hours and minutes, respectively, and a plurality of second analog and second digital display means for displaying the time in hours and minutes, respectively, of the time of recall of each of said reminder messages, wherein each analog display means represents an hour position on said clock means and each digital display means comprises a digital read-out disposed adjacent each of said analog display means, and wherein said first and second analog display means comprises a common set of first display elements disposed in a generally circular manner on said clock means, and wherein said first and second analog display means are color coded with said first analog display means having a first color and said second analog display means having a second color for respectively representing the current time in hours and the hour of recall of a reminder message, and wherein said first and second digital display means comprise a common set of second numeric display elements each disposed adjacent a respective one of said first display elements for respectively indicating the current time in minutes and the recall time of a reminder message in minutes, and wherein each of said first display elements is disposed at a respective hour indicating position on said clock means;

keyboard means disposed on said clock means for entering the reminder messages and the time for recall of each of said reminder messages;

controller means coupled to said clock means and to said keyboard means for processing said reminder messages and recall times associated therewith and for providing said recall times to said clock means;

memory means coupled to said controller means for storing said reminder messages for subsequent recall at said recall times by said controller means; and alphanumeric display means disposed on said clock means and coupled to said controller means for displaying said reminder messages read from said memory means by said controller means at a respective one of said recall times.

2. The reminder clock of claim 1 further comprising AM/PM indicating means disposed on said clock means adjacent to each of said plurality of first and second analog display means.

3. The reminder clock of claim 1 wherein each of said first display elements is a light emitting diode (LED), a liquid crystal diode (LCD), or other source of color coded light.

4. The reminder clock of claim 1 wherein said controller means is adapted for reading from said memory means reminder messages associated with a date other than the current date entered via said keyboard means for recalling said reminder messages from said memory means and displaying said reminder messages on said alphanumeric display means and the times associated therewith on said clock means.

5. The reminder clock of claim 4 further comprising day display means for providing a visual display of the selected day for which said reminder messages are displayed.

6. The reminder clock of claim 5 wherein said day display means comprises a plurality of LEDs or LCDs, each representing a given day including the current day and a selected number of next consecutive days.

7. The reminder clock of claim 1 further comprising a perpetual calendar for displaying the day and date of a current month, said calendar further including stored message display means for displaying the recall time of reminder messages for each day of a given month.

8. The reminder clock of claim 1 further comprising a plurality of second analog display means for displaying current time in seconds.

9. The reminder clock of claim 8 wherein each of said plurality of second analog display means includes a plurality of LEDs disposed about an associated digital minutes display means, with each LED illuminating with the passage of each second.

10. The reminder clock of claim 1 further comprising a plurality of second digital display means for displaying current time in seconds.

11. The reminder clock of claim 10, wherein each second digital display means is disposed adjacent an associated pair of first analog and first digital display means.

* * * * *

UNITED STATES PATENT AND TRADEMARK OFFICE

CERTIFICATE OF CORRECTION

PATENT NO. :5,199,009

DATED :March 30, 1993

INVENTOR(S) :Geno Svast

It is certified that error appears in the above-identified patent and that said Letters Patent is hereby corrected as shown below:

| COLUMN | LINE | |
|---|---|---|
| 5 | 15 | "ar" should be --are-- |
| 5 | 27 | "da" should be --day-- |
| 9 | 35 | After "day", insert --,-- |
| 10 | 28 | "op®ration" should be --operation-- |

Signed and Sealed this

Fourth Day of January, 1994

Bruce Lehman

*Attest:*

BRUCE LEHMAN

*Attesting Officer*

*Commissioner of Patents and Trademarks*